US006428905B1

(12) United States Patent
Behr et al.

(10) Patent No.: US 6,428,905 B1
(45) Date of Patent: Aug. 6, 2002

(54) DOUBLE SHEET METAL CONSISTING OF TWO COVERING METAL SHEETS AND AN INTERMEDIATE LAYER

(75) Inventors: Friedrich Behr, Krefeld; Klaus Blümel, Dinslaken; Horst Mittelstädt, Bochum; Cetin Nazikkol, Duisburg; Werner Hufenbach, Dresden; Frank Adam, Weissig, all of (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 09/623,782

(22) PCT Filed: Mar. 9, 1999

(86) PCT No.: PCT/EP99/01513

§ 371 (c)(1),
(2), (4) Date: Jan. 10, 2001

(87) PCT Pub. No.: WO99/46461

PCT Pub. Date: Sep. 16, 1999

(30) Foreign Application Priority Data

Mar. 12, 1998 (DE) ..... 198 10 706

(51) Int. Cl.[7] ..... B32B 3/02; E04C 2/32

(52) U.S. Cl. ..... 428/594; 428/600; 428/626; 228/173.6; 228/185

(58) Field of Search ..... 428/594, 600, 428/626; 228/173.6, 185

(56) References Cited

U.S. PATENT DOCUMENTS

| | | | | |
|---|---|---|---|---|
| 3,256,669 | A | | 6/1966 | Seiwert |
| 4,559,274 | A | | 12/1985 | Kloppe et al. |
| 5,228,252 | A | * | 7/1993 | Nehls |
| 5,390,467 | A | * | 2/1995 | Shuert |
| 5,444,959 | A | * | 8/1995 | Tesch |
| 6,063,507 | A | * | 5/2000 | Blumel et al. |

FOREIGN PATENT DOCUMENTS

| | | | |
|---|---|---|---|
| DE | 195 03 166 | * | 3/1997 |

* cited by examiner

*Primary Examiner*—Deborah Jones
*Assistant Examiner*—Jason Savage
(74) *Attorney, Agent, or Firm*—Prokauser Rose LLP

(57) ABSTRACT

The invention relates to a double-layered sheet comprising two cover sheets (1, 2) with a space between them, and a fill material (3) which fills the space between said cover sheets. Said fill material is made of plastic, in particular of porous duroplastic plastic, comprising embedded hard bodies (6, 7, 8, 9). In order to obtain the best possible geometrical moment of inertia while keeping the weight per surface area low, and in particular in order to prevent shearing out under pressure, of the cover sheet (1) acting as a compression chord, during pressing together of the double-layered sheet, the fill material is characterised by at least two stress/strain characteristic curves. In particular the fill material comprises pores which are sealed off from each other. The plastic fraction of the fill material (3) which acts as a matrix for the hard bodies (6, 7, 8, 9) determines the softer stress-strain characteristic curve, while the hard bodies (6, 7, 8, 9) determine the harder stress-strain characteristic curve.

18 Claims, 1 Drawing Sheet

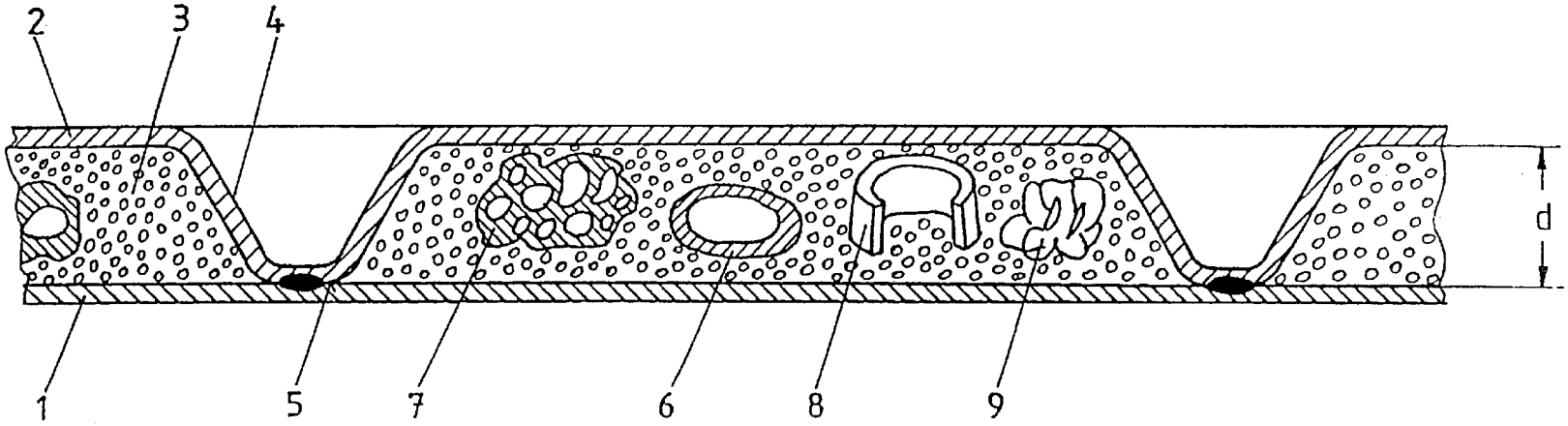
D
1
2
3
4
5
6
7
8
9

DOUBLE SHEET METAL CONSISTING OF TWO COVERING METAL SHEETS AND AN INTERMEDIATE LAYER

BACKGROUND OF THE INVENTION

Double-layered sheet comprising two cover sheets with a space between them, with at least one of said cover sheets being a burled sheet welded to the other cover sheet at the extremities of its burls, and comprising a fill material made of at least two different materials, said fill material filling the space between said cover sheets.

Various types of double-layered sheets of this kind are known (DE 195 03 166 A1; DE 196 06 981 A1; U.S. Pat. No. 4,559,274; Stahl und Eisen [Steel and Iron] 117 (1997), no. 10, page 46).

Such double-layered sheets which are also known as burled sheets, are above all used in the construction of vehicles, because they are characterised by excellent rigidity at relatively low weight and within certain limits are still workable, in particular deep-drawable. The characteristic thickness of the cover sheets is less than 1 mm, in particular less than 0.5 mm; the characteristic thickness of the fill material is between 1 and 5 mm. In the known double-layered sheets various materials are inserted as fill material, for example perforated mats in particular made of plastic or cellulose, or perforated aluminium sheets. In the case of perforated mats or aluminium sheets, the burls of the burled sheet engage the holes of the mat.

In the case of a soft fill material such as cellulose, the fill material is compressed when the sheet is subjected to a bending load. Consequently, even at relatively light loads, the bending rigidity of the sheet decreases rapidly. If perforated aluminium sheeting is used as fill material, the aluminium sheet prevents close approximation of the cover sheets because the aluminium sheet supports the cover sheets. With increasing bending power there is however the danger of the double-layered sheet opposite the centre of pressure which acts as a tension chord, tightening and via the aluminium sheet buckling against the direction of force, the cover sheet facing the centre of pressure of the bending power which acts as a compression chord.

Apart from the requirement for creating a double-layered sheet with good rigidity at low weight per surface area, there is also a requirement for the most economical production possible. It goes without saying that the further apart the weld spots at the extremities of the burls, the lower the expenditure.

Furthermore, a double-layered sheet is known (U.S. Pat. No. 4,559,274) whose cover sheets are burled sheets, welded together at the burls. In the space between the cover sheets a fill material made of two different materials, namely a flexible middle layer of foam, jute, metal wool or similar, and exterior layers made of a synthetic foamable material, are arranged. When the double-layered sheet is heated up, the foamable material foams, thus completely filling the voids. The state of the art does not provide any information concerning the individual formability behaviour of the different types of materials.

SUMMARY OF THE INVENTION

It is the object of the invention to create a double-layered sheet of the type mentioned in the introduction, which provides a better ratio between geometrical moment of inertia and weight per surface area than is the case with conventional double-layered sheets, and which does not have a tendency to failure as a result of buckling.

According to the invention this object is met by a double-layered sheet of the type mentioned in the introduction, in that the behaviour of the fill material during pressing together of the double-layered sheet under operational loads is characterised by at least two stress-strain characteristic curves in perpendicular direction to the plane of the sheet.

In the double-layered sheet according to the invention, at light bending power, the fraction of the fill material with the soft stress-strain characteristic curve determines the elastic line of the double-layered sheet. If the bending force increases, the fraction of the fill material with the harder stress-strain characteristic curve becomes effective, which prevents further approximation of the cover sheets and thus further reduction of the moment of inertia of the double-layered sheet.

In order to better withstand the opposing shear load of the chords caused by bending in a minimum of weld points at the extremities of the burls, one embodiment of the invention provides for the fill material to be bonded to the cover sheets over the entire surface.

Preferably the softer stress-strain characteristic curve is selected such that the effective spring excursion determined by said curve is 2% to 8% of the thickness of the fill material. For the softer stress-strain characteristic curve, the E-module perpendicular to the plane of the sheet (Z direction) should be less than 50 MPa while for the harder curve it should be significantly more than 50 MPa and significantly less than 210,000 MPa. Preferably it should be at least 500, better still 1,500 MPa.

The behaviour of the fill material during pressing together of the double-layered sheet which is characterised by the two stress-strain characteristic curves without the supportive effect of the burls, can for example be realised in that the fill material comprises in particular a porous plastic as a matrix with embedded particles of a material determining the harder stress-strain characteristic curve. A fill material with an E-module in Z direction of less than 20 MPa is particularly suitable as the fraction of the fill material forming the matrix.

Preferably, the fraction of the fill material forming the matrix is formed by a plastic in which dispersed hollow spherules of plastic are distributed, which melt at an average temperature below the temperature for full curing (cross-linking). This is in particular a duroplastic material as this results in a duroplastic foam being created by the melting of the hollow spherules forming the pores. As an intermediate layer in the double-layered sheet, due to its dimensional stability, the said foam allows forming of the double-layered sheet, in particular deep-drawing, without significantly impeding rigidity of the double-layered sheet due to delamination and crack formation in the fill material. In addition it can withstand stove-enamelling temperatures of up to approx. 220° C.

In order to keep the weight per surface area of the double-layered sheet as low as possible, one embodiment of the invention provides for the fraction of the fill material constituting the matrix of plastic to comprise dispersed hollow spherules of plastic of up to 70% by volume, with the melting of said hollow spherules in the fill material of the finished component generating distributed pores sealed off from each other. The harder stress-strain characteristic curve of the fill material is preferably determined by hard bodies which can be contained in the fill material at up to 10% by volume or which can account for up to 5% of the weight of the double-layered sheet. In order to let the soft stress-strain characteristic curve display its full effect when hard bodies are used, the dimension of the hard bodies in the direction perpendicular to the sheet plane (Z direction) should be 2% to 8% smaller than the distance between the cover sheets. On average, the mutual distance between all hard bodies in the sheet plane should be 3 to 7 times the distance of the cover sheets. Glass spheres, ceramic spheres or metal spheres are suitable as hard bodies. However, hard bodies made of glass or ceramic can only be used if the double-layered sheet need not be weldable during assembly, i.e. if no current bridge need be required for resistance welding of the cover sheets. Otherwise the use of metal hard bodies is indicated. The hardness of the hard bodies should be less than that of the cover sheets, so that during forming of the double-layered sheet they do not damage the cover sheets. Hollow shapes such as for example bent chips, spattered grain, fragments of metal foam for example from unkilled steel melt, or aluminium hollow powder are suitable shapes for hard bodies. In the case of sharp-edged metal hard bodies, for example made of bent steel chips or aluminium chips, welding during assembly can easily be carried out. This is because during resistance welding, when the cover sheets are pressed together, the metal hard bodies cut through the fill material comprising plastic which has not yet cured, thus forming an electric contact bridge between the cover sheets at the weld point.

According to a further proposition of the invention, a plastic, which during heat treatment cures to a viscous/tenacious state, should be used as a fill material. Preferably complete curing (cross-linking) should take place at between 150° C. and 230° C. Complete curing in this temperature range is advantageous insofar as this is the same temperature range as that for stove-enamelling. In this way, stove enamelling on the double-layered sheet and full curing of the plastic can then take place in one process step.

Furthermore, the invention also relates to a method for producing a double-layered sheet which through the use of in particular fill material comprising hard bodies made of metal is characterised by the following steps:

a) The fill material made of thermally curing plastic with deformable hard bodies, is applied to the burled side of the cover sheet which is a burled sheet, the dimension of said hard bodies perpendicular to the sheet plane being at least equal to the distance between the cover sheets.

b) The other cover sheet is applied, pressed on so as to spread the fill and then welded or hard soldered in the region of the extremities of the burls.

c) Following partial curing of the plastic, the double-layered sheet is subjected to pressure such that the hard bodies are deformed and reduced to a size smaller than that of the distance between the cover sheets.

d) After pressure release, the fill material is cured to a viscous/tenacious state.

After welding on or hard soldering in the region of the extremities of the burls, the cover sheet should be pressed on anew so as to distribute the fill material to any remaining spaces.

If the double-layered sheet is to be formed, forming should take place between partial curing and full curing of the plastic of the fill material because forming in the partially cured state can take place without negatively affecting the geometrical moment of inertia. If forming were to take place in the fully cured state, cracks in the fill material and delamination from the chords may occur. Full curing can be carried out with epoxy resin such that existing cracks and delamination are self-repairing.

Application of the fill material with deformable hard bodies can take place by extrusion or in the shape of a perforated mat of partly cured plastic, with the perforation of said mat matching the burl pattern. As a plastic, duroplastic adhesives have been shown to be more suitable than thermoplastic adhesives. The use of epoxy adhesive is advantageous because such adhesives provide electrical conductivity, albeit small, which ensures that during electrostatic painting, paint also adheres to the cut edges of the double-layered sheet.

BRIEF DESCRIPTION OF THE DRAWINGS

The sole FIGURE is a cross-section view of a double-layered sheet in accordance with the present invention.

DETAILED DESCRIPTION OF THE INVENTION

Below, the invention is illustrated in more detail by means of an embodiment, showing a section of a double-layered sheet.

The double-layered sheet comprises two cover sheets 1, 2, of galvanised steel sheet forming a space between them, with the thickness of each of said cover sheets being less than 0.5 mm, in particular 0.30 mm, as well as a fill material 3 filling the space between the cover sheets. One cover sheet 1 which when used as a motor body sheet forms the outer panel, is smooth; by contrast, the other cover sheet 2 comprises burls 4 in the shape of truncated cones, which at the face 4*a* are welded or hard-soldered to the smooth cover sheet 1. The height of the burls 4 and thus the distance d between the cover sheets 1, 2 is between 1 and 5 mm. The burls 4 are spaced 15 mm to 40 mm apart.

The fill material 3 comprises plastic, in particular an epoxy resin, a hardener, an accelerator and a hydrocarbon resin, with said fill material constituting the matrix for the various types of bodies embedded therein. The qualities of the plastic 3 are such that at room temperature or slightly increased temperatures it does not completely cure and remains vitreous, while at increased temperatures of approx. 170° C. to 210° C. it cures completely (cross-linked) to a viscous/tenacious state. Such a plastic allows forming and in particular deep drawing in the partially cured state. Such a plastic is bonded to the cover sheets 1, 2, which increases the shear strength of the double-layered sheet and thus relieves the shear load of the double-layered sheet at the welded faces of the burls 4.

To keep the weight per surface area low, a multitude of very small hollow spherules made of thermoplastic or duroplastic plastic up to a volume of 70% are embedded in the plastic fill material 3. The hollow spherules are made from a plastic material which melts at an average temperature of approx. 140° C. The hollow spherules then leave voids in the preferably duroplastic plastic, said voids being sealed off from each other, so that a duroplastic foam results.

In addition, hard bodies of the same type or of a different type are embedded in the plastic fill material 3. These hard bodies, preferably of metal, can be hollow spheres 6, metal foam fragments 7, short bent metal chips 8 or so-called spattered metal grain 9. It is important that the dimension of these hard bodies 6–9 in the formed finished component, perpendicular to the plane of the double-layered sheet, is smaller than the dimension d between the cover sheets 1, 2. In the sheet metal plane, the diameter of the individual hard bodies should be larger than the dimension d between the cover sheets 1, 2, with the dimension between them in the geometric average of the sheet plane being 3 to 7 times the dimension d between the cover sheets 1, 2. The sum of the two distances possible in Z-direction between the hard bodies 6–9 and the cover sheets 1, 2 should be 2% to 8% of the dimension between the cover sheets 1, 2 in the finished shaped component.

It is also important that the hard bodies 6–9, at least in part, comprise sharp edges so as to cut through the fill material 3 used as a matrix and so as to be able to establish electrical contact between the cover sheets 1, 2 before full curing in the stove-enamelling device. The production and use of chips made of aluminium die castings has been shown to be particularly advantageous because they break off bent to the shape of a ¾-circle (3 to 8 mm in diameter) and provide sufficiently sharp edges at a chip thickness ranging from 0.2 to 0.4 mm.

Production of the described double-layered sheet is such that the fill material 3 either by extrusion or in the shape of a partially-cured perforated mat with the perforation according to the distribution of the burls 4, is applied to the cover sheet 2 whose burls 4 point upward. The diameter or the height of the metal hard bodies 6–9 which for example account for 1–3% of the weight of the entire double-layered sheet, exceeds the future distance d between the cover sheets 1, 2. The fill material is applied so as to be somewhat raised in relation to the faces 5 of the burls 4. Now the cover sheet 1 is put in place, subjected to pressure at the burls and welded together at the faces 5 of the burls, before being completely subjected to pressure to the dimension d so as to distribute the fill compound. After partial curing of the fill material 3, renewed exposure to pressure takes place in a suitable tool (deep drawing tool, pair of rollers, press) so that the hard bodies 6–9 which are too big are reduced to a dimension smaller than the future distance d between the cover sheets 1, 2. Due to the elasticity of the burls and the foam, the sheet springs back to thickness d once the pressure is released. Full curing takes place either immediately afterwards or during stove enamelling at a later stage.

If the double-layered sheet is to be shaped, for example for use in the construction of vehicles, forming and in particular deep drawing takes place after partial curing before full curing. This state is eminently suitable for forming. While some fracturing and partial delamination of the intermediate layer from the cover layers may take place, this will be reversed because the pores extend by approx. 10% in linear direction, thereby pushing the still adhesive compound to the chords. It has also been shown that in particular a duroplast foam produced as described above does not leak out during full curing for 20 minutes at temperatures exceeding 200° C., so that during stove-enamelling, the paintwork is not damaged by drops leaking out.

What is claimed is:

1. A double-layered sheet comprising first and second cover sheets having a space therebetween, with at least one of the first and second cover sheets being a burled sheet comprising a plurality of burls, and wherein the first and second cover sheets are welded to one another at extremities of the burls, the double-layered sheet further comprising a fill material which fills the space between the first and second cover sheets and comprises a porous plastic matrix having hard particles embedded therein, and wherein behavior of the fill material during pressing together of the double-layered sheet under operational loads is characterized by at least two stress-strain characteristic curves.

2. The double-layered sheet according to claim 1, wherein the fill material is bonded to a surface of the first and second cover sheets.

3. The double-layered sheet according to claim 1, wherein during pressing together of the double-layered sheet, an effective spring excursion, determined by a softer stress-strain characteristic curve, is 2% to 8% of a thickness of the fill material.

4. The double-layered sheet according to claim 1, wherein an elasticity module for a softer stress-strain characteristic curve is less than 50 MPa.

5. The double-layered sheet according to claim 1, wherein an elasticity module for a harder stress-strain characteristic curve exceeds 500 MPa.

6. The double-layered sheet according to claim 5, wherein the elasticity module for the harder stress-strain characteristic curve is 1,500 MPa.

7. The double-layered sheet according to claim 1, wherein an elasticity module for a softer stress-strain characteristic curve of the fill material without embedded particles is less than 20 MPa.

8. The double-layered sheet according to claim 1, wherein the fill material comprises up to 70% by volume of hollow spherules.

9. The double-layered sheet according to claim 1, wherein the hard particles embedded in the fill material account for up to 10% by volume or up to 5% by weight of the double-layered sheet.

10. The double-layered sheet according to claim 9, wherein the hard particles comprise glass, ceramic or metal.

11. The double-layered sheet according to claim 10, wherein the hard particles comprise bent chips, foam, spattered grain or hollow powder.

12. The double-layered sheet according to claim 10, wherein the metal comprises steel, titanium, aluminum or magnesium.

13. The double-layered sheet according to claim 9, wherein the hard particles are 2% to 8% smaller, in a plane perpendicular to the cover sheets, than a distance between the cover sheets.

14. The double-layered sheet according to claim 9, wherein an average mutual distance between the hard particles in a plane perpendicular to the cover sheets is 3 to 7 times a distance between the cover sheets.

15. The double-layered sheet according to claim 1, wherein the porous plastic matrix cures to a viscous/tenacious state when subjected to heat.

16. The double-layered sheet according to claim 15, wherein the porous plastic matrix completely cures at a temperature in the range of 150° C. to 230° C.

17. A method for producing a double-layered sheet according to claim 1, comprising the following steps:

a) applying the fill material to a burled side of the first cover sheet, wherein the size of the hard particles, in a plane perpendicular to the cover sheets, is at least equal to a distance between the cover sheets;

b) applying the second cover sheet and pressing together the first and second cover sheets and subsequently welding the first and second cover sheets to one another at the extremities of the burls;

c) partially curing the porous plastic matrix and subsequently subjecting the double-layered sheet to pressure such that the hard particles are deformed and reduced to a size smaller than that of the distance between the cover sheets; and d) releasing the pressure and subsequently curing the fill material to a viscous/tenacious state.

18. The method according to claim 17, wherein after the step of welding the first and second cover sheets to one another, the fill material is distributed to remaining spaces by again pressing-on the second cover sheet.

* * * * *